United States Patent [19]

Tang

[11] Patent Number: 4,686,497

[45] Date of Patent: Aug. 11, 1987

[54] ADJUSTABLE WAVEGUIDE SHORT CIRCUIT

[75] Inventor: Douglas D. Tang, Chelmsford, Mass.

[73] Assignee: GTE Laboratories Incorporated, Waltham, Mass.

[21] Appl. No.: 873,576

[22] Filed: Jun. 12, 1986

[51] Int. Cl.[4] ..... H01P 1/28

[52] U.S. Cl. ..... 333/253; 333/248

[58] Field of Search ..... 333/157, 159, 248, 249, 333/253, 263

[56] References Cited

U.S. PATENT DOCUMENTS

| | | | |
|---|---|---|---|
| 2,762,973 | 9/1956 | Kallmann | 333/157 X |
| 2,863,128 | 12/1958 | Gilchrist et al. | 333/253 |
| 2,944,234 | 7/1960 | De Ronde | 333/253 |
| 4,538,125 | 8/1985 | Beckmann et al. | 333/248 |

*Primary Examiner*—Paul Gensler

*Attorney, Agent, or Firm*—Fred Fisher

[57] ABSTRACT

An adjustable waveguide short circuit using a thin partition or rectangular pin parallel to the E-field in the waveguide and movable along longitudinal slots centrally located on the two broad walls of the waveguide.

9 Claims, 7 Drawing Figures

ADJUSTABLE WAVEGUIDE SHORT CIRCUIT

BACKGROUND OF THE INVENTION

1. Field of the Invention

This invention relates to adjustable waveguide short circuits and, in particular, to computer-controlled adjustable non-contacting waveguide short circuits. Accordingly, it is a general object of this invention to provide new and improved waveguide short circuits of such character.

2. General Background

An adjustable waveguide short circuit is desirable as a diagnostic tool for carrying out various measurements including determining the noise figure of a microwave amplifier.

As background, the noise figure for a microwave amplifier is given by the equation:

$$F=F_{min}+4r_n(|\Gamma_s-\Gamma_0|^2)/\{(1-|\Gamma_s|^2)|1+\Gamma_0|^2\}$$

where $r_n$=equivalent input noise resistance, $F_{min}$=minimum noise figure, $\Gamma_0$=source reflection coefficient for minimum noise figure, F=noise figure, $\Gamma_s$=source reflection coefficient for noise figure F.

In the foregoing equation, $r_n$, $F_{min}$, and $\Gamma_0$ are considered as device characteristics, and are generally determined by measurements. The relationship between F and Γhd s is bilinear. For a given noise figure F, the solution for $\Gamma_s$ lies on a circle. Thus, prior to circuit design, $r_n$, $F_{min}$, and $\Gamma_0$ should be determined. As $\Gamma_0$ is generally complex, there are four unknowns in the equation for F.

The unknowns can be determined by utilizing four input circuits having four known values of $(\Gamma_s)_i$, i=1 to 4, and measuring the noise figure $F_i$, i=1 to 4, resulting from each of these $(\Gamma_s)_i$ values. This results in four simultaneous equations with four unknowns, which can be solved to give the values of $r_n$, $F_{min}$ and $\Gamma_s$. Generally, to improve accuracy, more than four values of $\Gamma_s$ are used, and the unknowns are determined by regression technique.

Two alternative methods have been used to provide the required source $(\Gamma_s)_i$. One method uses a noise source followed by a tuner. Different values of $(\Gamma_s)_i$ are obtained by different settings on the tuner. The second method utilizes an adjustable short circuit in series with a precision attenuator of known attenuation. This combination has been used to terminate the main arm of a directional coupler and a noise source is connected to the coupled arm. The magnitude of $(\Gamma_s)_i$ is determined by the attenuator and the phase by the adjustable short circuit. Of these two methods, the second method is preferred and widely used in the determination of noise characteristics of low noise microwave amplifiers used in receivers.

With either method, the first step is to measure the source reflection coefficient, $(\Gamma_s)_i$, on an automatic network analyzer. The source is then connected to the amplifier under test, and the noise figure of the amplifier is measured. This procedure is repeated at least four times with a different $\Gamma_s$ each time to obtain the necessary four equations in the four unknowns. Disadvantageously, this procedure is unreliable because in going from the analyzer to the amplifier under test the settings of the tuner or the short circuit may have changed inadvertently, causing subsequent measurements to be erroneous. The procedure is not reliably repeatable because it is very difficult to repeat exactly the settings of an adjustable tuner or a contacting type adjustable short circuit. Hence, previous settings and measured $(\Gamma_s)_i$ cannot be reused. The prior art procedure has been tedious and time consuming, especially when more than one amplifier is to be characterized.

SUMMARY OF THE INVENTION

Another object of this invention is to provide for a new and improved adjustable waveguide short circuit.

Still another object of this invention is to provide for a non-contacting type of waveguide short circuit for applications in the second method as described hereinabove.

Yet still another object of this invention is to provide for an improved non-contracting type of waveguide short circuit in which the position of the short circuit can be set either manually or electronically by a computer-controlled micro-stepping motor to thereby provide both accuracy and repeatability.

Still yet another object of this invention is to provide a new and improved non-contacting type of waveguide short circuit which is reliable and in which measurements can be both accurate and repeatable.

In accordance with one aspect of the invention, an adjustable waveguide short circuit includes a waveguide having one portion adapted to receive and/or transmit a signal and a second portion coupled to the first portion formed along an arcuate path. A vane is traversable along the arcuate path and adaptable to bifurcate the waveguide. Means are provided for stepping the vane along the arcuate path.

In accordance with another aspect of the invention an adjustable waveguide short circuit includes a waveguide having a first portion coupled to a second portion. The first portion is adapted to be coupled to receive and/or transmit a signal. The second portion is formed along an arcuate path having an axis. A vane is pivotable about the axis of the arcuate path and adaptable to bifurcate the waveguide. Means are provided for stepping the vane about the arcuate path.

In accordance with certain features of the invention, the arcuate path can have solely one axis. The vane can be pivotable about the axis to bifurcate the waveguide without physically contacting the waveguide. The waveguide can have a width a whereby signals having a wavelength $a<\lambda<2$ a can travel through the first portion to the second portion and whereby the vane reflects signals of the wavelength λ when $a<\lambda<2$ a. The waveguide, in another feature, can have a width a whereby signals having a wavelength $a<\lambda<2$ a can travel through the first portion to the second portion but whereby the vane inhibits passage of signals of the wavelength λ when $a<\lambda<2$ a. The stepping means can be computer controlled. The first portion of the waveguide device can define a linear path.

In accordance with still another yet another aspect of the invention, an adjustable waveguide short circuit can include a waveguide having a first portion coupled to a second portion. The first portion defines a linear path and is adapted to receive and/or transmit a signal. The second portion is formed along an arcuate path and has solely one axis. The waveguide has a width a. A vane is pivotable about the axis of the arcuate path and is adaptable to bifurcate the waveguide without physically contacting the waveguide. Thus, signals having a wavelength $\lambda$, where $\lambda<2$ a, can travel through said first portion to the second portion, whereby the vane reflects signals of the wavelength $\lambda$ when $a<\lambda<2$ a. Further, the vane inhibits passage of signals of the wavelength $\lambda$ when $a<\lambda<2$ a. Means are provided for stepping the vane about the arcuate path, the stepping means being computer controlled.

BRIEF DESCRIPTION OF THE DRAWINGS

Other objects, advantages and features of this invention, together with its construction and mode of operation, will become more apparent from the following description, when read in conjunction with the accompanying drawings, in which.

DESCRIPTION OF PREFERRED EMBODIMENT(S)

Figure 1:
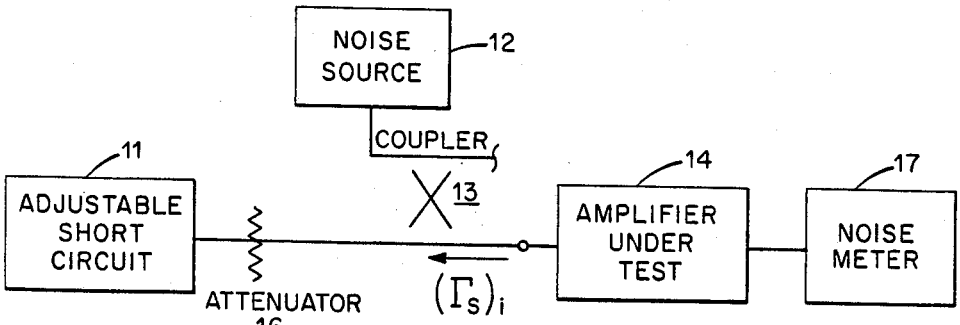
FIG. 1 is a block diagram of a set-up for noise figure measurements helpful for an understanding of this invention.

Referring to FIG. 1, there is depicted in block diagram an adjustable short circuit 11. The invention utilizes a non-contacting type of waveguide short circuit in which the position of the short circuit can be set either manually or electronically by a computer-controlled micro-stepping motor, as will become more apparent from the description that follows. Hence, both accuracy and repeatability are provided. Thus, any number of pre-determined short circuit positions can be set by the computer and the resulting input reflection coefficient $(\Gamma_s)_i$ can be measured over the frequency range of interest by an automatic network analyzer, controlled by the same computer. Measured values of $(\Gamma_s)_i$ are stored in the memory of the computer for subsequent calculation. The source combination can then be connected to the amplifier under test and all settings can be repeated for automatic noise measurements controlled by the same computer, without the necessity for further connecting and disconnecting.

Referring again to FIG. 1, a noise source 12 is coupled by a suitable means 13 to the amplifier 14 under test. The amplifier 14 under test is coupled to the adjustable short circuit waveguide 11 via an attenuator 16. The signals received by the amplifier 14 under test from the noise source 12 are detected by the noise meter 17.

Figure 2:
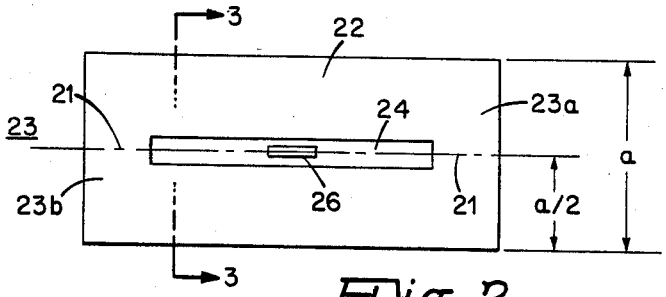
FIG. 2 is a plan view of a slotted waveguide with a movable thin partitioning vane or post helpful for an understanding of this invention.

In a rectangular waveguide 23, depicted in FIG. 2, propagating only the dominant $TE_{10}$ mode, the currents flowing along the centers 21—21 of the broad walls 22—22 of the waveguide 23 are purely longitudinal. Therefore, narrow slots 24—24 cut along the centers of the broad walls 22—22 do not interrupt the flow of current, and hence do not disturb the field inside the waveguide 23, or incur loss due to radiation.

The foregoing is the basic principle of waveguide slotted lines that are used in standing-wave measurements, where a narrow slot is cut along the center of one broad wall and a thin probe is inserted slightly into the waveguide to sample the field.

Figure 3:
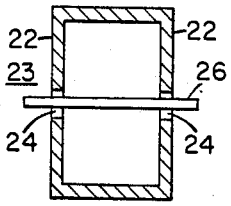
FIG. 3 is a sectional view of the slotted waveguide with movable thin partitioning vane depicted in FIG. 2, taken along the line 3—3 thereof.

Thus, without affecting the fields inside the waveguide 23, a narrow slot 24 can be cut along the center of each of the two broad walls 22—22, as shown in FIGS. 2 and 3. When a thin vane or partition 26 is inserted through the waveguide 23 from the slot 24 on one broad wall 22 to the other 22, the original waveguide 23 is bifurcated. Each half 23*a*, 23*b* has a dimension of a/2 in a direction perpendicular to the electric field and the direction of propagation. This increases the cutoff frequency in the bifurcated region to twice that in the original waveguide. Thus, the original field can not propagate into the bifurcated region, and is totally reflected by the partition 26, when the length of bifurcation is in the order of one quarter wavelength in free space. When the partition 26 is made movable along the slots 24—24, an adjustable non-contacting short circuit is obtained.

Figure 4:
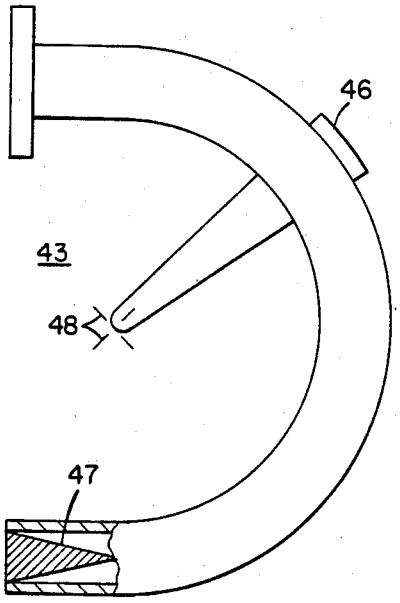
FIG. 4 is a planar view, partly in section, of a movable partition short circuit with the waveguide forming part of a circle, in accordance with one embodiment of the invention.
Figure 5:
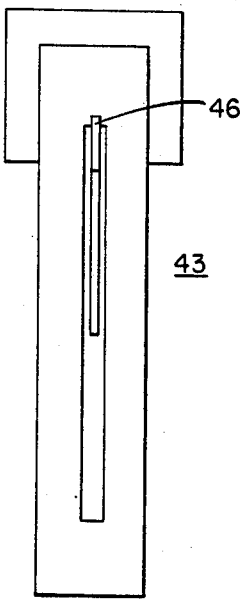
FIG. 5 is a side view of the device depicted in FIG. 4.

Referring to FIGS. 4 and 5, the positioning of the partition or vane 46 is greatly facilitated when the waveguide 43 is formed into a circular arc with its electric field along the direction of the radius, as shown in FIG. 4, where the waveguide 43 forms a portion of a circle. A load 47 is used at the end of the waveguide 43 to absorb any small amount of power that might be transmitted in order to eliminate multiple reflections. As desired, depending upon the length of the waveguide, the waveguide can form a complete circle, a portion of a circle, or different radii can be utilized. The movable partition 46 is pivoted about the center 48 of the circle, and is mounted on a shaft of a stepping motor, thereby providing precise, speedy and repeatable control of the position of the short circuit.

Figure 6:
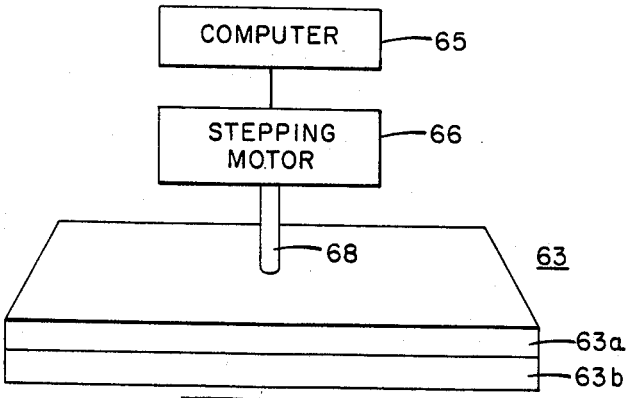
FIG. 6 is a view, partly in perspective and partly diagrammatic, illustrating a computer-controlled adjustable non-contacting waveguide short circuit in accordance with an embodiment of the invention.

Referring to FIG. 6, there is generally depicted a waveguide 63 including an upper portion 63*a* and a lower portion 63*b*. A computer 65 is coupled to control a stepping motor 66 to incrementally rotate or step the shaft 68 which is coupled to the movable partition within the waveguide 63.

Figure 7:
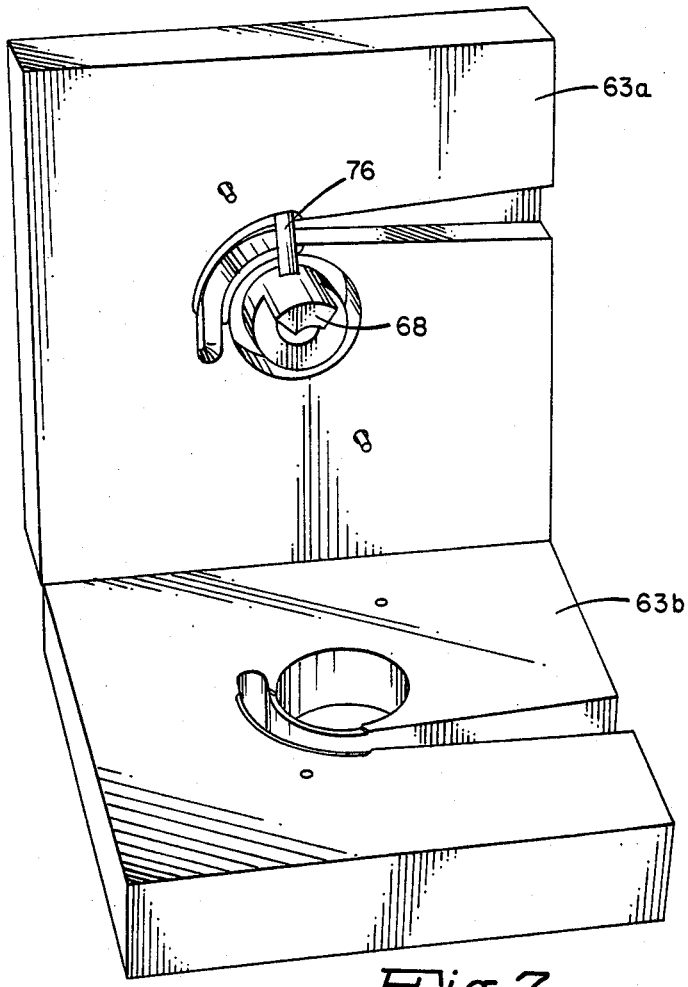
FIG. 7 is a breakaway view of the waveguide depicted in FIG. 6 to show the inner workings thereof.

FIG. 7 depicts the two halves of the waveguide 63 in open position. Note, that the movable partition 76 is pivotable about the center of the circle and is mounted on the shaft 68 of the stepping motor 66.

Various modifications may be made without departing from the spirit and scope thereof.

What is claimed is:

1. An adjustable waveguide short circuit comprising a waveguide having a first portion coupled to a second portion, said first portion being adapted to receive and/or transmit a signal, said second portion being formed along an arcuate path;

a flat vane, occupying a portion of said waveguide, traversable along said arcuate path and adaptable to bifurcate said waveguide with near full penetration thereinto to cause total reflection of said signal by making said portion a waveguide beyond cutoff; and means for stepping said flat vane along said arcuate path.

2. An adjustable waveguide short circuit comprising a wavelength having a first portion coupled to a second portion, said first portion being adapted to be coupled to receive and/or transmit a signal;

said second portion being formed along an arcuate path having an axis; a flat vane, occupying a portion of said waveguide, pivotable about said axis of said arcuate path and adaptable to bifurcate said waveguide with near full penetration thereinto to cause total reflection of said signal by making said portion a waveguide beyond cutoff; and means for stepping said flat vane about said arcuate path.

3. The adjustable waveguide short circuit as recited in claim 2 wherein said arcuate path has solely one axis.

4. The adjustable waveguide short circuit as recited in claim 2 wherein said flat vane is pivotable about said axis to bifurcate said said waveguide without physically contacting said waveguide.

5. The adjustable waveguide short circuit as recited in claim 2 wherein said waveguide has a width a and whereby signals having a wavelength $\lambda<2$ a can travel through said first portion to said second portion, and whereby said flat vane reflects signals of said wavelength $\lambda$ when $a<\lambda<2$ a.

6. The adjustable waveguide short circuit as recited in claim 2 wherein said waveguide has a width a and whereby signals having a wavelength $\lambda<2$ a can travel through said first portion to said second portion, but whereby said flat vane inhibits passage of signals of said wavelength $\lambda$ when $a<\lambda<2$ a.

7. The adjustable waveguide short circuit as recited in claim 2 wherein said stepping means is computer controlled.

8. The adjustable waveguide short circuit as recited in claim 2 wherein said first portion of said waveguide defines a linear path.

9. An adjustable waveguide short circuit comprising a waveguide having a first portion coupled to a second portion, said first portion defining a linear path and being adapted to receive and/or transmit a signal, said second portion being formed along an arcuate path having solely one axis, said waveguide having a width a;

a flat vane, occupying a portion of said waveguide, pivotable about said axis of said arcuate path and adaptable to bifurcate said waveguide without physically contacting said waveguide with near full penetration thereinto to cause total reflection of said signal by making said portion a waveguide beyond cutoff, whereby signals having a wavelength $\lambda$, where $\lambda<2$ a, can travel through said first portion to said second portion, and whereby said flat vane reflects signals of said wavelength $\lambda$ when $a<\lambda<2$ a; and whereby said flat vane inhibits passage of signals of said wavelength $\lambda$ when $a<\lambda<2$ a; and means for stepping said flat vane about said arcuate path, said stepping means being computer controlled.

* * * * *